United States Patent [19]

Bierman

[11] 4,358,058

[45] Nov. 9, 1982

[54] AUTOMATIC FOGGING NOZZLE

[76] Inventor: Scott A. Bierman, 679 S. Wickham Rd., Baltimore, Md. 21229

[21] Appl. No.: 230,021

[22] Filed: Jan. 30, 1981

[51] Int. Cl.[3] ..... B05B 1/16

[52] U.S. Cl. ..... 239/447

[58] Field of Search ..... 239/443–449; 169/48

[56] References Cited

U.S. PATENT DOCUMENTS

| | | | |
|---|---|---|---|
| 89,456 | 4/1869 | Allen . | |
| 214,778 | 4/1879 | King . | |
| 567,925 | 9/1896 | Shoots | 239/444 X |
| 575,596 | 1/1897 | Dozle . | |
| 577,616 | 2/1897 | Day . | |
| 2,345,813 | 4/1944 | Harrison . | |
| 2,376,881 | 5/1945 | Nielsen | 239/448 X |
| 2,389,642 | 11/1945 | Schellin | 299/147 |
| 3,163,363 | 12/1964 | Travis | 239/441 |

*Primary Examiner*—Andres Kashnikow

*Attorney, Agent, or Firm*—John F. McClellan, Sr.

[57] ABSTRACT

Firefighting apparatus for rapidly dispersing water spray into a super heated atmosphere with as little effort on the part of the fire fighter as possible includes a nozzle providing a whirling fog cone wide angle discharge coaxial with a conventionally supplied narrow angle forward discharge, by means of water pressure spinning of a rotatable section having angled fog heads; control is by handle which can provide for forward discharge, or combination forward and wide angle fog cone discharge, or can shut off all flow; to provide optimum control with smooth flow a transverse cylindrical shape valve body is decentered relative to the bore of the system and has a tapered passage through it; the invention also gives the fire fighter the option of injecting the apparatus into an involved structure without subjecting himself to any more danger than necessary.

2 Claims, 5 Drawing Figures

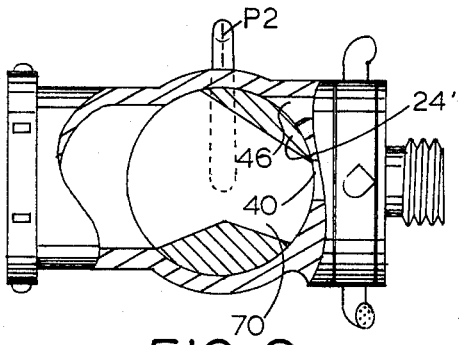
FIG. 2
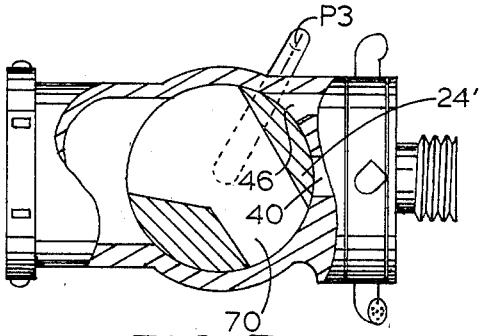
FIG. 3
FIG. 4
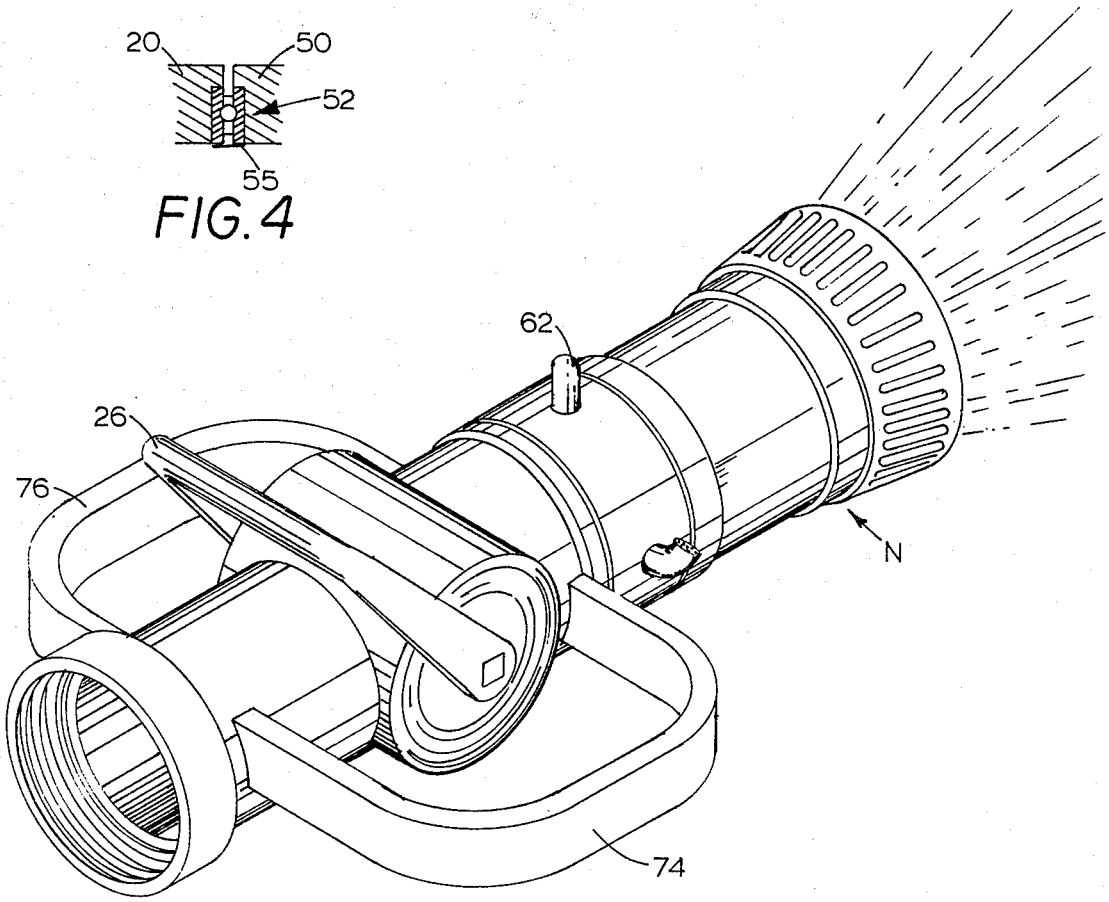
FIG. 5

AUTOMATIC FOGGING NOZZLE

FIELD OF THE INVENTION

This invention relates generally to fire fighting equipment and specifically to firehose nozzles.

BACKGROUND OF THE INVENTION

In the prior art various disclosures have been made of fogging nozzles and other types in combination, including those of the following U.S. Patent Nos.:

No. 3,163,363 issued to R. L. Travis on 12-29-64 discloses a nozzle which can provide a straight stream, a hollow cone, a solid cone or a combination of cone and straight-stream;

No. 2,389,642 issued to J. C. Schellin et al, on 11-27-45, discloses a nozzle with variations providing alternatively a straight stream or a conical stream, and in one variation a combination of streams simultaneously;

No. 2,345,813 issued to W. R. Harriman on 4-4-44, discloses a nozzle with swinging mechanism to alter flow;

No. 577,616 issued to E. L. Day on 2-23-97 discloses a nozzle with valve control to emit a conical spray and/or a central stream spray;

No. 575,596 issued to P. J. Doyle on 1-19-97, discloses another form of nozzle which is valve controlled to emit a solid spray, a conical spray, or both;

No. 214,778 issued to C. W. King on 4-29-79, discloses a lawn sprinkler which emits both a conical stream from a rotary portion and a straight jet stream from the central portion;

No. 89,456 issued to A. F. Allen on 4-27-1869 discloses a nozzle controllable to emit both conical and straight through streams, or straight through alone.

However, the old art is believed not to provide the advantages of the present invention apparent in the objects thereof, which include:

to provide firefighters with a new nozzle system giving them the option of 1.) a straight through stream which may be a fogging stream of a conventional fogging nozzle is used on the exhaust end of the invention, of 2.) of the straight through stream in combination with a whirling fogcone, or 3.) shutting off flow.

Translated to advantages such choice will provide for entering a blazing enclosure and avoiding or reducing the hazards of shooting high volume, high velocity fog ahead. These hazards result from the jet-pump effect of the forward directed fog stream which at the same time as it produces high pressure when it impinges, lowers pressure along the periphery of the fog and in a two-way action of pushing and pulling causes hot gases from the enclosure to blowback past the nozzle area. Depending on direction of fog discharge and enclosure shape, these hot gases may scour one side of the nozzle area preferentially, or the top or bottom, instantly raising the temperature to hazardous levels and exhausting the oxygen.

According to objects of this invention, on demand a protective whirling cone of fog can be extended as a shield ahead of the firefighting team at the nozzle to confine and cool gaseous discharge from a blazing enclosure, and importantly, would tend to average out blowback temperature by the whirling, the whirl beating aside and breaking up hot currents of gases. Although fixed-multiple-outlet cone fogging nozzles are known they cannot provide the whirling-cone fogging action.

Further objects are to provide a system as described which is easy to use, unmistakable in operational adjustment under the most adverse circumstances, reliable, moderate in cost, adaptable in size, durable, and convenient to use, and which can be injected into an involved structure without subjecting the firefighter user to any more danger than necessary.

BRIEF SUMMARY OF THE INVENTION

In brief summary given as cursive description only and not as limitation, the invention includes a firefighting nozzle system with means for providing a whirling wide angle cone of fog in combination with a forward narrow angle cone of fog or solid stream conventionally provided, or for providing the forward narrow angle cone alone, or for shutting off all flow, under control of an indicated-position handle.

BRIEF DESCRIPTION OF THE DRAWINGS

The above and other objects and advantages of the invention will become more apparent from the following description, including the drawings in which like characters denote like parts:

FIGS. 2 and 3 are partly-sectional details showing successive positions of valving in the invention;

FIG. 4 is a diagram in section of a bearing detail; and

FIG. 5 is a perspective view of the invention indicating action in use.

DETAILED DESCRIPTION

Figure 1:
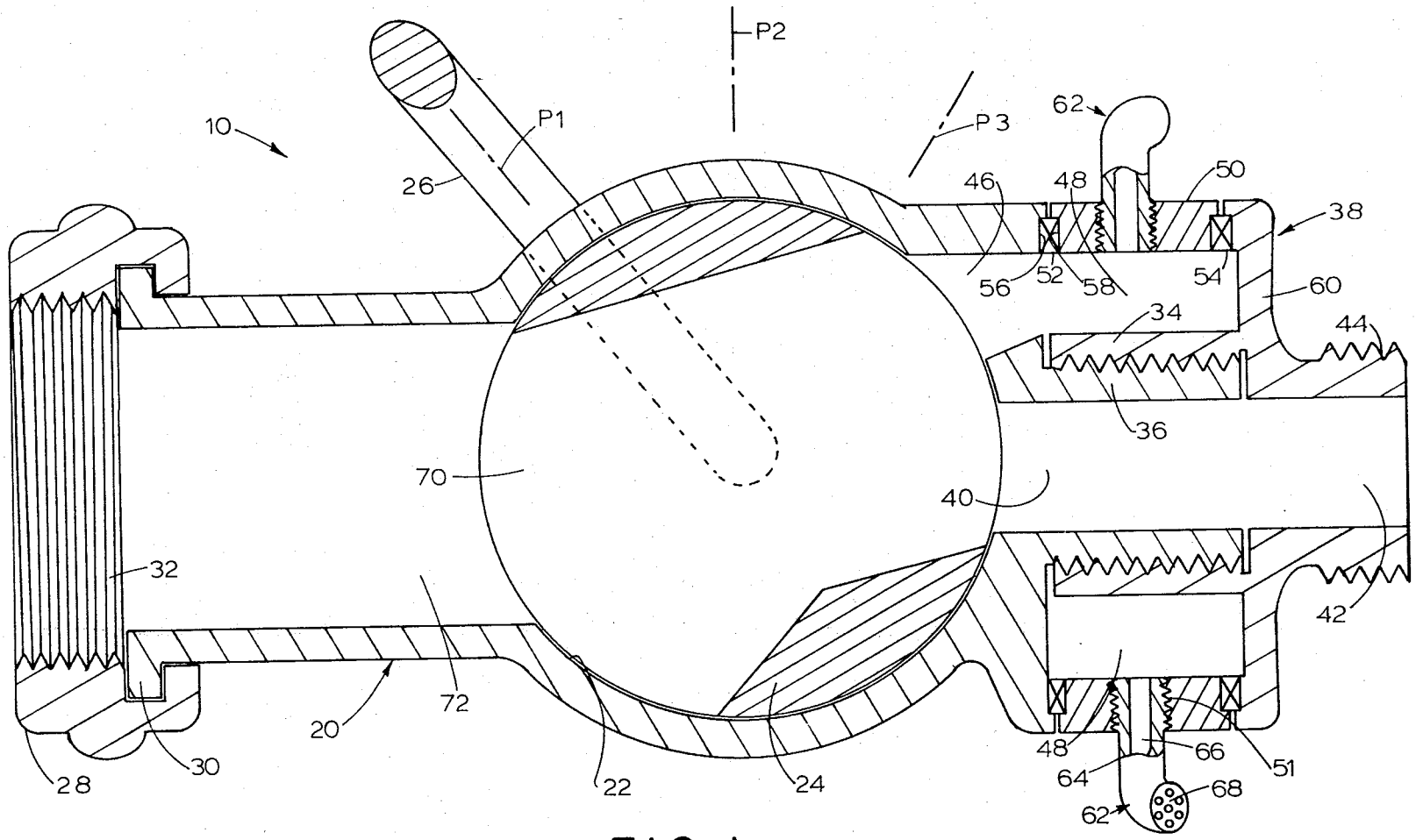
FIG. 1 is a longitudinal-sectional view of the invention.

FIG. 1 shows the invention 10 as involving generally only four major elements in a nozzle system.

A tubular housing or body 20 houses in a transverse cylindrical journal portion 22 thereof a cylindrical valve body 24. The valve body is controllable in operating position by a handle 26 extending from it on the exterior. A coupling or threaded ring 28 captivated by a flange 30 around the rear of the body 20 provides for conventional fire hose attachment. A first threaded connection 32 is to attach a conventional fire hose to the body 20.

The body has an axial bore 40 downstream that connects with the valve. The front assembly has an axial bore 42 that aligns with that of the body and is surrounded by a second or forward threaded connection 44 for attaching a standard fog nozzle or the like downstream of or ahead of the front assembly.

Above the body concentric bore and generally parallel with it a passage 46 extends from the valve chamber 22 forwardly to annular chamber 48 concentrically within the front assembly 38. The outer wall or sleeve 50 of the annular chamber can rotate on ball bearings 52, 54 respectively mounted congruently to the respective forward and rearward edges of the rotary outer wall and held by recesses 56, 58 in the inner perimeter of it and opposed forwardly by a similar recess in the front assembly housing 60 and rearwardly by a similar recess in the body 20.

The sleeve or rotary outer wall 50 bears a plurality of equally spaced fog expelling heads or fog nozzles 62, at least four being preferable. Each fog nozzle conventionally may include a threaded radial shank 64 screwed in the outer wall or sleeve 50 at pipe threads 51 and connecting through a bore 66 in it the annular chamber 48 to a spray plate 68 comprising a plurality of openings in an angled end of the fogging nozzle. Range of speed of rotation of the whirling fog cone can be set by wrenching the projecting fog heads, adjusting the rotational setting about the pipe threads to produce the desired speed at design pressure and flow The angled ends may incline substantially transversely to the fogging nozzle bore 66 and a few degrees out of parallel with the concentric bore 42, all in the same direction so that reaction of water expulsion will spin the rotary outer wall 50.

To control the operation of the system the transverse cylindrical valve body 24 is decentered or offset relative to the housing bore axis in the housing and has through it a tapered passage 70 proportioned for passing water from the entrance bore 72 forwardly in full flow in first and second modes through first and second angular positions $P_1$, $P_2$ of the valve. The decentering permits the tapered passage to be more nearly uniform in shape.

In the first angular position the valve handle is to the rear and water flows through both the passage 46 for the conical fogging or propelling of whirling spray cone and through concentric passages 40 and 42 for the projecting substantially axially the straight through fogging (or solid stream, depending on a conventional nozzle attached to the forward end to threads 44).

FIGS. 2 and 3 diagram the other two modes in positions of operation. With the handle at $P_2$ in the perpendicular or up position, the forward part of the passage 70 in the valve body passes water only through the concentric bore positions for straight-through spraying, passage 46 being closed by the upper portion 24' of the valve body. With the handle inclined in forward position at $P_3$ all water is shut off by action of the upper portion 24' of the rotary cylindrical valve body which covers both passages 46 and 40 in the third mode. To adjust the whirling fog cone speed and volume within the speed range set-in by wrench adjustment of angle while preserving full flow forwardly, the handle is placed at selected incremental positions between $P_1$ and $P_2$.

Materials for the invention may be conventional, the body portions and valve may be brass or stainless steel or "Pyrolite", for example.

FIG. 4 indicates that the bearing may be conventional ball or roller combination thrust and radial load bearings 52 with pressure sealing rubber or plastic flaps 55 on the inner faces and anchored to one race. Any other suitable conventional bearing may be used for the purpose.

FIG. 5 shows the invention to use with a conventional fog nozzle N attached at the forward end. Grips 74, 76 on the exterior provide for holding the system free of the handle 26 and rotating parts or fog expelling heads and sleeve.

Control positions are such that the "off" position stops the rotating part well before the knuckles approach the area. In densest smoke, the handle position will, by feel, indicate the setting and the rotation of the fog expelling heads can be felt also for assurance that they are operating. The valve body can be conventional, disassembled by unscrewing a circular end plate after removing the handle which may be of two parts screwed together; none of this conventional structure is shown, to keep the exposition simpler.

It can be seen from the above that the means for controlling includes the valve and handle and passages in the housing. "O"-ring seals may be conventionally used for the valve.

This invention is not be be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a nozzle system with a housing having means for projecting a substantially axial stream of fog and the like from a nozzle forwardly onto a fire in an enclosure and the like, coupling means for introducing liquid at a first end of the housing, and means including a handle for controlling passage of liquid through the housing, the improvement comprising: means for shielding against and breaking up hot gas currents blown back to the nozzle system as result of said projection of fog, including means for propelling a whirling cone of fog against said hot gas currents, said means for controlling selectively limiting operation to: a first mode in which the means for projecting and the means for propelling concurrently operate, a second mode in which only the means for projecting operates and a third mode in which both the means for projecting and the means for propelling are inoperative; the means for controlling including valving means in the form of a transverse cylindrical journal in said housing, a cylindrical valve body with a valve passage therethrough in said transverse cylindrical journal, said means for projecting a substantially axial stream of fog including said housing having a first passage extending axially of the housing in a forward direction from said valving means for connection to said nozzle for liquid flow thereto; said means for propelling including a second passage offset from the first passage and extending forwardly from the valving means for conducting liquid to an annular recess at said means for propelling, a rotary sleeve around said annular recess, and a plurality of fog expelling heads mounted on said rotary sleeve in position causing reaction from fog expulsion by said fog expelling heads to rotate said rotary sleeve.

2. In a nozzle system as recited in claim 1, said transverse cylindrical journal having an axis, the axis of said transverse cylindrical journal being offset from said housing axis in a direction promoting flow through said valve passage by permitting said passage to be more nearly uniform in shape; in said second mode the handle being in an intermediate or second, position; in the first mode and the third mode the handle being in respective first and third positions inclined on respectively different sides of said second position, and the handle inclining closest to the rotary sleeve in the third position.

* * * * *